US005681637A

United States Patent [19]

Kessler et al.

[11] Patent Number: 5,681,637

[45] Date of Patent: Oct. 28, 1997

[54] MICROORGANISM RESISTANT PILE WEATHERSTRIPPING

[75] Inventors: Ronald Kessler, Girard, Ohio; Steve Abramson, Rochester, N.Y.

[73] Assignee: Aller-Gard 100 Products, Inc., Youngstown, Ohio

[21] Appl. No.: 724,345

[22] Filed: Oct. 1, 1996

Related U.S. Application Data

[60] Provisional application No. 60/010,987, Feb. 1, 1996.

[51] Int. Cl. [6] ..... D04H 11/00; E06B 7/22

[52] U.S. Cl. ..... 428/85; 428/96; 428/907; 49/475.1

[58] Field of Search ..... 428/85, 88, 89, 428/96, 907; 49/475.1

[56] References Cited

U.S. PATENT DOCUMENTS 4,551,376 11/1985 Kessler ..... 428/85

*Primary Examiner*—Alexander Thomas

*Attorney, Agent, or Firm*—Browdy and Neimark

[57] ABSTRACT

A fin pile-type weatherstrip having a propylene polymer barrier fin is made resistant to mold, mildew and fungi by the incorporation of about 2–3% by weight of zinc pyrithione, or another suitable microbiocide which is environmentally acceptable.

9 Claims, 1 Drawing Sheet

MICROORGANISM RESISTANT PILE WEATHERSTRIPPING

This application claims benefit under 35 U.S.C. 119(e) of parent copending provisional application Ser. No. 60/010,987 filed Feb. 1, 1996, entitled "Germ Resistant Pile Weatherstripping".

FIELD OF INVENTION

The present invention relates to pile-type weatherstripping, and more particularly to an improved pile-type weatherstripping incorporating a propylene polymer barrier fin which is resistant to microorganisms.

BACKGROUND

Weatherstripping material is important in the conservation of energy and is used to provide a barrier to air between a variety of fixed and movable elements, such as between slidable or swingable elements including windows or doors and the like, and the fixed elements within which they are mounted for movement. Forty years ago, felt, copper strips and cloth members were adequate for filling the cracks generated by the movement between moving members of doors and windows and their frames. An early improvement was the provision of pile-type weatherstripping.

However, one of the problems with pile-type weatherstripping without the fin was that the pile fibers permitted the passage therethrough of air, and therefore this type of weatherstripping in some environments failed to provide a solution for the very problem for which it was needed, namely to provide an air barrier. This problem was essentially solved by the Horton U.S. Pat. No. 3,175,256, which provided an impervious barrier fin within the pile. The product of Horton thus combined the air impervious fin with the attractive pile material.

Today the sophistication of modern science has provided weatherstripping that is multipurpose and long lasting. Today's weatherstripping will not seize, due to cohesion between the sliding surfaces, will not scratch the glass that is transported across the strip, and will not be made ineffective by strong blasts of wind and rain.

Thus, all of these things are prevented by such pile-type weatherstripping aided by one or two layers of plastic barrier film inserted in the center of the pile, the purpose of which is to resist strong gusts of wind, which forces the film to push against the mating surface thus helping to resist the wind and rain forces. Thus, the best type of weatherstripping barrier is a solid element, such as a plastomeric or elastomeric fin or the like, which presents a solid barrier to prevent the passage of cold air from one side of the weatherstripping, or warm air from the other side. Such weatherstripping material has now been known and used for many years.

So-called pile-type fin weatherstripping has a major advantage in high customer acceptance; in essence, pile-type weatherstripping has achieved its great success because the ultimate customer, i.e. the consumer, likes the way it looks.

Over the years many variations of pile-type fin weatherstripping material have been developed. Briefly, the Yackiw U.S. Pat. No. 4,242,392 discloses a fin pile-type weatherstripping wherein the fin is formed of a porous material impregnated with paraffin, the paraffin being stated to act as a lubricant. Kessler U.S. Pat. No. 4,551,376 discloses a lubricated pile-type fin weatherstrip having a U- or V-shaped fin the cavity of which contains a lubricant for increased lubricity. As disclosed in Burros U.S. Pat. No. 4,214,930, the barrier fin may be formed of a variety of plastic materials, although polymers of propylene, e.g. polypropylene, are most conventionally used in modern pile-type fin weatherstripping because of its exceptional ability to be repeatedly flexed and bent without becoming brittle and breaking.

This system of resisting wind and rain penetration has been very effective and widely used. However, as with all systems, there are some disadvantages that plague this system. The biggest disadvantage of this system is that it accumulates moisture at the base of the pile. Mainly due to the fact that the pile members are waterproof for durability, this accumulation of moisture can only be reduced by evaporation, a long process even when favorable conditions for evaporation are present. The accumulation of moisture over a period of time can be a prime source for the growth of microorganisms, e.g. bacteria, fungi, mold and mildew.

It is known to place insecticides in plastic bodies, e.g. pet collars, to protect pets from insects such as fleas. Also see Farquharson et al U.S. Pat. No. 4,888,174 which discloses the controlled release of an insecticide from a blend of polyethylene and an ethylene copolymer. In addition, there is a body of prior art which shows the incorporation of various bacteriostatic, microbiocidal and/or antibacterial agents in fibers, yarns or the like: for example, Lowes U.S. Pat. No. 3,198,765 discloses bacteriostatic acrylonitrile fibers containing polychlorinated phenols; Harrington et al U.S. Pat. No. 3,161,622 discloses polyamide fibers having microbiacidal activity, and Berry U.S. Pat. No. 3,345,341 discloses a polyamide yarn containing a metal salt of pentachlorophenate or pentachlorophenyl esters as antibacterial agents; and Hyman U.S. Pat. No. 3,247,058 discloses PVC films containing organo tin compounds which impart both thermostability and bacteriocidal activity.

So far, however, and insofar as is known, the above identified problem of the development and growth of microorganisms on pile-type fin weatherstripping has not been solved, and the incorporation of germicides into the polypropylene barrier film and/or pile of the weatherstrip has not been carried out or taught. Thus, the need continues to exist for a pile-type fin weatherstrip which is resistant to the development of microorganisms.

SUMMARY OF THE INVENTION

It is accordingly an object of the present invention to overcome deficiencies of the prior art, such as indicated above.

It is another object of the present invention to provide a weatherstrip, particularly a pile-type weatherstrip, including a barrier fin of propylene polymer which will inhibit the growth of microorganisms and thus avoid a potential health hazard.

It is a further object of the present invention to minimize the accumulation of microorganisms on pile-type fin weatherstripping by providing a leaching or contact germicide in the plastic material from which the film and/or pile is made.

Briefly, these objects are achieved by the incorporation of a suitable germicide material into the plastic material from which the components of the fin pile-type weatherstrip material is made, preferably at least the propylene polymer fin material and optionally also the pile material. The germicide should be of the character that it slowly leaches or exudes from the body of the fin and/or pile to the surface thereof over time, and so the germicide should be dispersible in the plastic and extrudable with the plastic from which the film and optionally the fibers of the pile are extruded, and so must be a material which will not degrade at the maximum temperature at which the propylene polymer is subjected during extrusion into the film and/or the fibers of the pile.

The above and other objects and the nature and advantages of the present invention will be more apparent from the following detailed description of certain embodiments of the invention, taken in conjunction with the drawing, wherein:

DETAILED DESCRIPTION OF EMBODIMENTS

Figure 1:
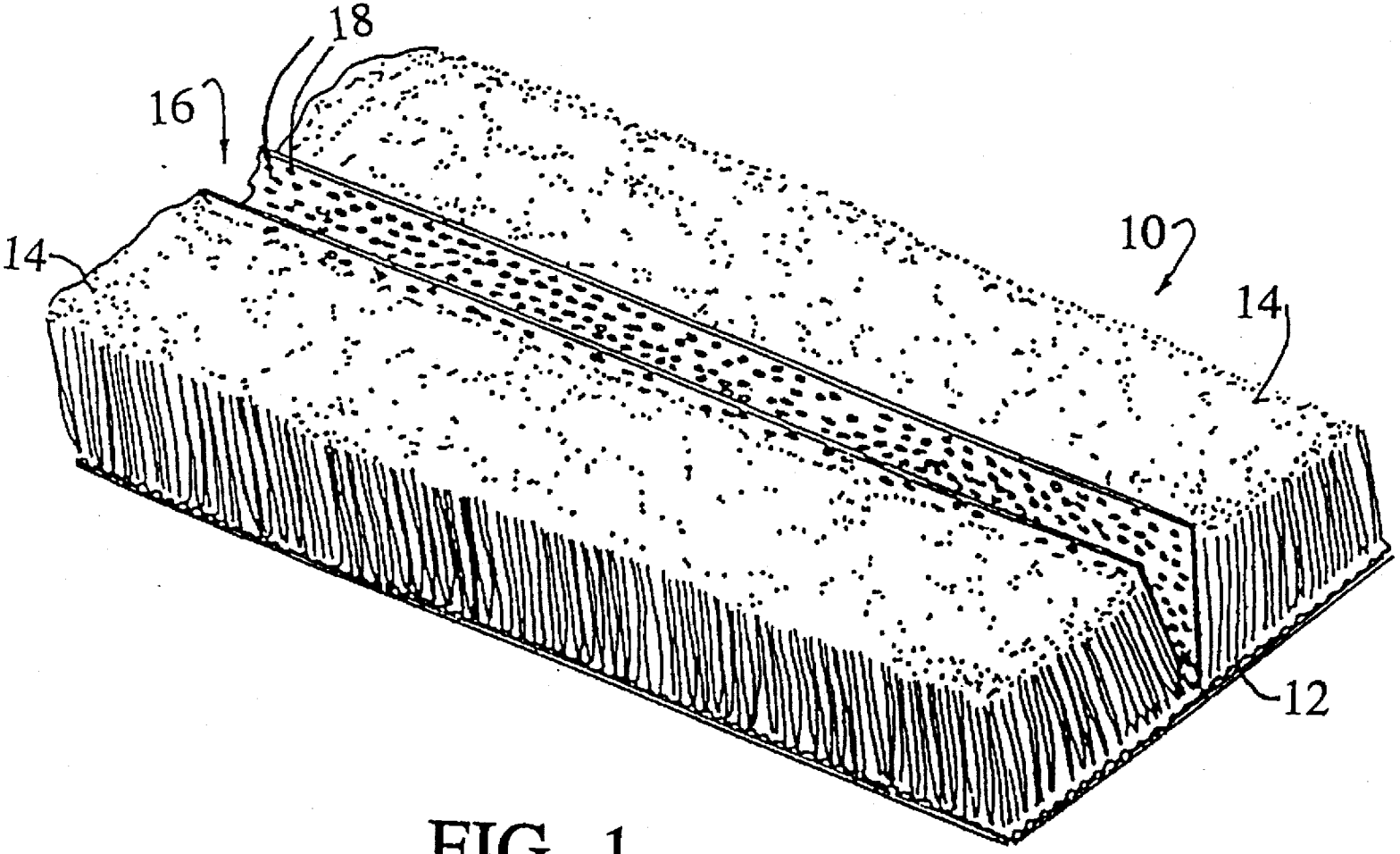
FIG. 1, the sole figure, is a perspective view of a typical fin pile-type weatherstrip in which the present invention can be embodied.

With reference to FIG. 1, a typical weatherstrip 10 in which the present invention can be incorporated includes an elongated strip of base material 12 and arrays of upstanding pile fibers 14 which are located on opposite sides of a barrier fin 16 which in the illustrated embodiment is doubled, i.e. V- or U-shaped, but may be only a single fin. The barrier fin 16 and the pile 14 project upwardly from a base strip 12 which may be formed of any suitable material, such as woven fabric, plastic, or even metal, and which may be a unitary layer of extruded thermoplastic material or a laminate of a woven thermoplastic fabric with an impervious layer therebeneath in accordance with known practice. The barrier fin 16 is connected in any conventional way, such as by ultrasonic welding along its bottom surface, to the base 12. Variations in these basic construction are known and are usable in accordance with the present invention.

In accordance with the present invention, at least one of the aforementioned members of the weatherstrip 10, most preferably the fin 16 and optionally also the pile fibers 14, are provided internally with a suitable germicide, schematically illustrated at 18, which will exude to the surface over time and prevent the accumulation of mold, mildew, fungus and bacteria. Germicides are readily available that can be used for this purpose, and these available germicide materials, such as OMACIDE-D and OMADINE (Olin Corp.), and BUSAN 11-M-1 (Buckman Labs), are incorporated into the required plastics from which pile and film are made, e.g. polypropylene, at for example a let down of about 2% to 5%. This combination then achieves the object of this invention: to provide a combination of plastics and germicide that reduces the possibility of the spread of microorganisms, especially bacteria, fungi, mold and mildew, in the damp areas of window and door junctures sealed by pile-type weatherstripping.

As indicated above, polypropylene has been a preferred material from which to manufacture the barrier fin. However, the normally used isotactic polypropylene has a melting point of about 165° C.; therefore, during extrusion, the necessary formation temperatures become very high and many germicides, which would otherwise be suitable for use in the present invention, cannot be used because they become degraded or otherwise damaged at the processing temperature for isotactic propylene. Therefore, it is preferred that the polymer from which the fin is made be either atactic polypropylene, which has melting point of only about 80° C., or a copolymer of propylene having melting point sufficiently low to obviate the above-identified problem, preferably lower than 150° C. and most preferably lower than 135° C. Known propylene copolymers are those in which propylene is copolymerized with ethylene, 1-butene, isoprene, divinylbenzene and phenylacetylene. These and other propylene copolymers can be routinely tested for suitability according to the present invention based on the present disclosure. It is also possible to lower the processing temperature of polypropylene in a known way by plasticizing the polypropylene, such as with petrolatum, polyethylene, DOS, bis(n-hexyl)azelate, bis(2-ethylhexyl) adipate and/or polybutene-1.

As indicated above, selection of an appropriate microbiocide is dependent on a number of factors. Such additive must be one which will migrate from the interior of the film and exude to the surface over time so as to be able to carry out its biocidal activity; it must not be a material which will degrade or be otherwise ruined at the processing temperature of the propylene polymer at its processing temperatures. In addition, many microbiocides used in the past are no longer considered environmentally acceptable, and thus most if not all chlorinated microbiocides should be avoided, and particularly chlorinated aromatic compounds. In addition, the microbiocide additive should not interfere with the weldability of the film, as ultrasonic welding of the fin to the base 12, whether the fin is multilayered or only a single ply, is its preferred method of attachment.

A preferred antimicrobial agent for use in the present invention has been found to be zinc 2-pyrimidinethiol-1-oxide which is a bacteriocide-fungicide more commonly known as zinc pyrithione, sold by Olin Corporation under the trademark Zinc OMADINE®, most commonly used as an anti-dandruff agent in shampoos. This compound decomposes at about 240° C. EPA registered uses of zinc pyrithione are as a paint and coating additive to inhibit the growth of algae, mold, mildew and bacterial slime in an amount of 5,000 ppm maximum (0.5%) on dry paint coatings; for the control of mildew and bacteria in styrene butadiene rubber and thermoplastic resins used in the manufacture of products such as carpet fibers, carpet backings, rubber or rubber-backed back mats, foam underlay for carpets, foam stuffing for cushion and mattresses, wire and cable insulation, plastic furniture, synthetic floor coverings, gaskets and weatherstripping, rubber gloves, garbage bags, garden hose, shower curtains, scrub brushes in amounts of up to 4,000 ppm (0.4%) in the finished product; and to inhibit the growth of bacteria and fungi on dry films of natural and synthetic adhesives, caulks, patching compounds, sealants and grouts in the amount of a maximum of 5,000 ppm (0.5%).

Other suitable microbiocides are, as indicated above, OMACIDE-D (Olin Corporation) and BUSAN 11-M-1 (Buckman Lab). Insofar as is known, these materials have never been used in conjunction propylene polymer films.

As indicated above, the microbiocides are used in the present invention in an amount of about 2–5%, preferably in the range of 2–3% based on the total quantity of propylene polymer and additive in the present invention.

The following examples, offered illustratively, will help further explain the invention.

EXAMPLE 1

Blends of propylene copolymer and zinc pyrithione in the amounts of 2%, 2.5% and 3% zinc pyrithione respectively are extruded into barrier film. Weatherstripping materials as shown in FIG. 1, except that they are in the form of single film layers, are fabricated and tested.

EXAMPLE 2

Example 1 is repeated using atactic propylene as the film material.

EXAMPLE 3

Sample weatherstrips containing zinc pyrithione were wiped clean and placed on the centers of agar plates. The agar plates were inoculated with *aspergillus fumigatus,* and the inoculated agar plates were incubated at 35° C. for 48 hours. After 48 hours, the plates were closely examined and revealed a zone of inhibition of 5–10 mm. A zone of inhibition remained after 9 days. In a further similar test, a zone of inhibition of 5–6 mm was observed 24 hours after initiation of the test.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. The means and materials for carrying out various disclosed functions may take a variety of alternative forms without departing from the invention. It is to be understood that the phraseology or terminology employed herein is for the purpose of description and not of limitation.

What is claimed is:

1. A fin and pile weatherstrip comprising a base strip; at least one a longitudinally extending row of pile attached to said base strip; and a barrier fin secured in an upright orientation along said base strip adjacent to said row of pile, wherein said barrier fin is formed of a propylene polymer containing an amount effective of a microbiocide to inhibit the growth of fungus, mold or mildew on the surface of said fin, up to about 5% by weight based on the total weight of said fin, and wherein said microbiocide does not degrade at the temperature of processing of said propylene polymer, and is capable of migrating from the interior of said fin and exuding to the surface thereof.

2. A weatherstrip according to claim 1 wherein said fin is welded to said base, and said microbiocide is one which does not cause a poor weld.

3. A weatherstrip according to claim 2 wherein said microbiocide is zinc pyrithione.

4. A weatherstrip according to claim 1 wherein said microbiocide is present in an amount about 2–3% based on the total weight of said fin.

5. A weatherstrip according to claim 4 wherein said microbiocide is zinc pyrithione.

6. A weatherstrip according to claim 5 wherein said propylene polymer is atactic polypropylene.

7. A weatherstrip according to claim 1 wherein said propylene polymer is atactic polypropylene.

8. A weatherstrip according to claim 1 wherein said propylene polymer is a propylene copolymer having a melting point no greater than 150° C.

9. A weatherstrip according to claim 1 wherein said propylene polymer is a propylene copolymer having a melting point no greater than 135° C.

* * * * *